US006412417B1

(12) United States Patent
Anderson et al.

(10) Patent No.: US 6,412,417 B1
(45) Date of Patent: Jul. 2, 2002

(54) IGNITER ASSEMBLY ACTUATED BY PARACHUTE DEPLOYMENT, AND FLARE CONTAINING THE SAME

(75) Inventors: Derek C. Anderson, Perry; Mark H. Pond, Garland; Ryan D. Osterhout, Layton, all of UT (US)

(73) Assignee: Alliant Techsystems Inc., Edina, MN (US)

( * ) Notice: Subject to any disclaimer, the term of this patent is extended or adjusted under 35 U.S.C. 154(b) by 0 days.

(21) Appl. No.: 09/619,311

(22) Filed: Jul. 19, 2000

Related U.S. Application Data

(60) Provisional application No. 60/145,129, filed on Jul. 22, 1999.

(51) Int. Cl.[7] ..... F42B 4/28
(52) U.S. Cl. ..... 102/337; 102/254
(58) Field of Search ..... 102/335–337, 102/235, 236, 254–256, 258, 261, 274

(56) References Cited

U.S. PATENT DOCUMENTS

| | | | | |
|---|---|---|---|---|
| 3,633,509 A | | 1/1972 | Grandy et al. | 102/35.4 |
| 3,782,885 A | * | 1/1974 | Weissmann | 431/255 |
| 4,029,014 A | | 6/1977 | Cunningham | 102/35 |
| 4,155,306 A | | 5/1979 | Herold et al. | 102/35 |
| 4,454,816 A | | 6/1984 | Billard et al. | 102/430 |
| 4,488,488 A | | 12/1984 | Looger et al. | 102/387 |
| 4,667,600 A | | 5/1987 | Jensen et al. | 102/254 |
| 4,811,664 A | * | 3/1989 | Levy et al. | 102/226 |
| 5,206,457 A | * | 4/1993 | Pascal et al. | 102/235 |
| 5,275,101 A | * | 1/1994 | Chemiere et al. | 102/235 |
| 5,347,931 A | | 9/1994 | Day | 102/340 |
| 5,375,526 A | | 12/1994 | Hoffmann | |
| 5,386,781 A | | 2/1995 | Day | 102/340 |
| 5,587,552 A | | 12/1996 | Dillehay et al. | 149/19.5 |
| 5,912,430 A | | 6/1999 | Nielson | 149/19.1 |

FOREIGN PATENT DOCUMENTS

| | | | |
|---|---|---|---|
| DE | 35 24 080 A1 | 1/1987 | F42C/1/02 |
| DE | 43 03 128 A1 | 8/1994 | F42C/9/14 |
| EP | 0 048 204 A1 | 3/1982 | F42C/15/18 |

* cited by examiner

*Primary Examiner*—Charles T. Jordan
*Assistant Examiner*—Kimberly S. Smith
(74) *Attorney, Agent, or Firm*—Sullivan Law Group

(57) ABSTRACT

This parachute flare igniter assembly has a novel slider for attaining high reliability in firing efficiency. The slider moves along a raceway of an igniter assembly housing. Also disposed in the housing is a cartridge retained in a stationary state relative to the housing. The cartridge includes a stationary primer and a spring. A striker arm connected to the cartridge is movable into a cocked state in which the spring urges the striker arm towards the primer. The slider has an igniter composition chamber and a cocking wall portion, and is movable in tandem with the igniter composition chamber along at least a portion of the length of said raceway from a loaded position to a firing position. In the loaded position, the striker arm is maintained in the cocked state by the cocking wall portion. In the firing position, the igniter composition chamber is aligned and in communication with the primer and the striker arm is free of the cocking wall portion to permit the spring to drive the striker arm from the cocked state into the primer with the force sufficient to detonate the primer.

17 Claims, 8 Drawing Sheets

IGNITER ASSEMBLY ACTUATED BY PARACHUTE DEPLOYMENT, AND FLARE CONTAINING THE SAME

RELATED APPLICATIONS

Priority is claimed of provisional application No. 60/145,129 filed in the U.S. Patent & Trademark Office on Jul. 22, 1999, the complete disclosure of which is incorporated herein by reference.

BACKGROUND OF THE INVENTION

1. Field of the Invention

This invention relates to a novel igniter assembly for igniting combustible compositions in a highly reliable manner, and in particular to an igniter assembly which includes a combustible illuminant composition and as actuated by deployment of an associated parachute. This invention also relates to devices comprising the novel igniter assembly, such devices including, by way of example, illuminating flares.

2. Description of the Related Art

Among the various environments in which illuminating flares are used, perhaps the most common environment for the use of flares involves the illumination of military battle grounds. In such applications, the flares are launched above ground or water areas suspected to contain enemy personnel and vehicles. Essentially, the illumination provided by the flare facilitates visual detection of the enemy personnel and vehicles, thereby providing more precise identification of target locations at which to aim arsenal. The illuminating effect provided by the flare is typically enhanced by equipping the flare with a parachute, which both increases the flight and time of descent for the illuminating flare and, upon deployment thereof, provides a requisite force for actuating an igniter housed in the flare.

The use of flares to ascertain the precise location of enemy targets can provide obvious military advantages. However, the availability and widespread use of military flares has negated this advantage somewhat, since there is an increased likelihood of opposing military forces also possessing flares. Thus, in order to gain a military advantage from the flares, it is paramount that the flares operate in a highly reliable and dependable manner, since flare failure can provide the opposing military force additional time to launch their own flares and arsenal.

An example of an illuminating flare that is reliable by conventional standards, e.g., about 87% of the time, is shown in FIGS. 5–7 herein. It is believed that one of the largest contributors, if not the largest contributor, to failed firing of this illuminating flare is the misfiring of the flare igniter. The flare, which is generally designated by reference numeral 200 in FIG. 5, comprises an aluminum casing 202 partitioned into two compartments. The forward compartment is the larger of the two compartments, and contains a solid illuminant fuel 204 designed to enhance nighttime vision and an igniter assembly 206 for initiating burning of the illuminant fuel 204. In the illustration, the aft compartment is the smaller of the two compartments, and contains a parachute 208 and a timing device (unnumbered). The timing device, inserted at an aft end of the casing 202, detaches from the flare casing 202 at a predetermined time to create a passageway through which the parachute 208 can deploy. Upon deployment through the passageway, the parachute 208 slows the rate of descent of the flare 200, thereby extending the time during which the burning illuminant fuel 204 is maintained at an elevated position. In this manner, the illuminating effect provided by the burning illuminant fuel 204 is enhanced.

A conventional igniter is disclosed in U.S. Pat. No. 4,155,306 and illustrated in FIGS. 6 and 7 herein. Referring to FIG. 6, the igniter 206 includes a housing 212 formed of a molded piece of LEXAN (polycarbonate) or light-weight metal. The housing 212 has longitudinally extending internal walls 213 and ridge 213*a*, which are receivable into an aluminum cap (not shown). The internal walls 213 and the ridge 213*a* define upper and lower hollow compartments 215, and a diametrically extending raceway 214 interposed between the upper and lower compartments 215. The raceway is defined in part by the ridge 213*a* of the internal wall 213. The ridge 213*a* has a depth less than that of the remainder of the internal walls 213. For convenience, the ridge 213*a* is shaded. The function of the ridge 213*a* is explained in further detail below.

A sliding cartridge (also referred to herein as a slider) 216 is disposed in the raceway 214 and is slidable along the raceway 214. The slider 216 comprises a spring-loaded striker arm 218, a torsion spring (located at position 220), and a pistol primer (containing small amount of explosive) 222. The striker arm 218 is depicted in a loaded or cocked position in FIG. 6. The torsion spring 220 urges the striker arm 218 to pivot about pin 224 and towards the position shown in FIG. 7, in which the striker arm 218 rests against the primer 222. A cam surface 225 of the housing 212 obstructs the striker arm 218 from moving towards the primer 222 and, in combination with the urging force of the spring 220, prior to actuation maintains the slider 216 in the position depicted in FIG. 6.

Located below the raceway 214 is a pellet cavity 226 containing an ignitable composition, such as boron potassium nitrate ($BKNO_3$) pellets. The pellet cavity 226 is in communication with the solid illuminant fuel 204 through an orifice (not shown).

The slider 216 is operatively connected to the parachute 208 via cable or lanyard 230, which extends along a cable raceway (not shown) formed in the aluminum casing 202. The cable 230 contains a first swage ball 232 accommodated within recess 234 for securing the cable 230 to the slider 216. The recess 234 is in communication with a slot 236, which is sufficiently wide to permit passage of the cable 230, but to obstruct passage of the first swage ball 232. At the end of the cable 230 is a second swage ball (not shown, but positioned behind the first swage ball 232 in FIG. 6). The cable 230 extends between the first swage ball 232 and the second swage ball along an axial direction, that is, perpendicular to the portion of the cable 230 passing through the slot 236 (i.e., into the sheet on which FIGS. 6 and 7 are shown). The second swage ball is encapsulated into the internal wall 213. The encapsulation of the second swage ball in the internal wall 213 serves as a safety mechanism to protect against unintentional firing by preventing tension in the cable 230 from prematurely moving the slider 216 along the raceway 214.

In operation, the igniter assembly 206 is actuated by the force generated upon parachute 208 deployment. Upon actuation of the parachute 208, the deploying parachute pulls the cable 230 towards the aft end of the flare 200. When properly operated, the force imparted on the cable 230 by the deploying parachute 208 is sufficient to dislodge the second swage ball from the housing 212 and move the slider 216 in tandem with striker arm 218 and the primer 222 across the raceway 214 with sufficient force to overcome the frictional resistance between the cocked striker arm 218 and the cam surface 225, as well as the frictional resistance between the slider 216 and the raceway 214, thus passing the striker arm 218 under the cam surface 225.

After the slider 216 has moved a sufficient distance for the striker arm 218 to clear the cam surface 225, the urging force of the torsion spring 220 pivots the striker arm 218 about pin 224 and towards the primer 222, which is now located over the cavity 226 containing pellets. Impact of striker arm 218 against the primer 222 detonates the primer 222. The heat and flames generated by the detonation of the primer 222 pass through an orifice and ignite the $BKNO_3$ pellets in cavity 226, which in turn ignites a wafer, which in turn ignites the solid illuminant fuel 204. Because the ridge 213*a* of the internal wall 213 extends in depth only a portion of the way across the depth of the raceway 214, a clearance is defined (between the ridge 213*a* and the opposing cap surface) through which the striker arm 218 can pass as the striker arm 218 pivots towards the primer 222.

Although effective by conventional standards, flares possessing the igniter assembly 206 function correctly only approximately 87% of the time. In the majority of the cases in which failure occurred, the slider mechanism 216 was found to have traveled only part of the way down the raceway, with the cable found either broken or intact. The reasons for these failures are believed to be as follows: The deployment of the parachute 208 imparts an instantaneous shock force to the cable 230, causing the second swage ball to dislodge from the slider wall in which the second swage ball is encapsulated. However, the remaining force imparted to the cable 230 by parachute deployment is not always sufficient to overcome additional frictional forces at the slider/raceway interface and the interface between the cocked striker arm 218 and the cam surface 225. These frictional forces can prevent the slider 216 from moving sufficient distance to clear the cam surface 225 and reaching and striking the primer 222. One reason for the high frictional force at the slider/raceway interface is that the cable does not pull at the center of the slider 216. Another reason is that the ridge 213*a* defining the top of the raceway 214 does not extend along the full depth of the slider 216 (in order to provide a clearance for passage of striker arm 218 as the striker arm 218 pivots from the cocked state to the firing state). The presence of this clearance is believed to allow the slider 216 to rotate somewhat about its longitudinal axis in the raceway 214 during sliding movement, thus increasing frictional forces.

SUMMARY OF THE INVENTION

It is, therefore, an object of this invention to overcome the above-discussed problems by the provision of an igniter assembly which reduces sticking of the slider in the raceway.

It is another object of this invention to provide an igniter assembly that has built-in safety features to significantly reduce the risk of the flare being accidentally fired due to impact. These safety features include, for example, the placement of the pellet cavity out of alignment with respect to the primer and striker arm prior to firing, and in one particularly advantageous embodiment, a static force minimum of preferably 50 lbs, more preferably 90 lbs, to cause ignition.

In accordance with a preferred embodiment of this invention, the striker arm and the primer are stationary relative to the igniter housing, in contrast to the known assembly shown in FIGS. 6 and 7. The pellet-containing chamber, which is stationary in the known assembly shown in FIGS. 6 and 7, is in accordance with the present invention incorporated into the slider so that the pellet chamber is not aligned with the striker arm in the cocked position. In the preferred embodiment, another feature for preventing the unintentional firing and ignition of the illumination composition involves providing the slider with a motion restricting bridge.

At least one of the following design features is desirably incorporated into the novel igniter assembly to accomplish the above and other objects, although the scope of the invention is not hereby limited. First, the igniter housing has raceway-defining walls having a depth (along the longitudinal direction of the flare) substantially equal to the depth of the slider, so that the slider does not contact any ridges during movement along the raceway. Second, greater symmetry is utilized in the slider to keep pulling forces in balance. Third, the distance of slider travel along the raceway is shortened. Fourth, the slider is made of a material that is more compatible with the igniter housing on a coefficient of friction basis. Fifth, the encapsulated swage ball is replaced by a less complex safety mechanism, such as a motion restricting bridge.

This invention is also directed to devices containing the novel igniter assembly. A representative non-limiting device intended to be covered by this invention is an illuminating flare.

This invention is also directed to a method of illuminating a field with an illuminating flare comprising the novel igniter assembly described herein.

Other objects, aspects and advantages of the invention will be apparent to those skilled in the art upon reading the specification and appended claims which, when read in conjunction with the accompanying drawings, explain the principles of this invention.

BRIEF DESCRIPTION OF THE DRAWINGS

The accompanying drawings serve to elucidate the principles of this invention by illustration. In such drawings.

DETAILED DESCRIPTION OF THE INVENTION

Figure 5:
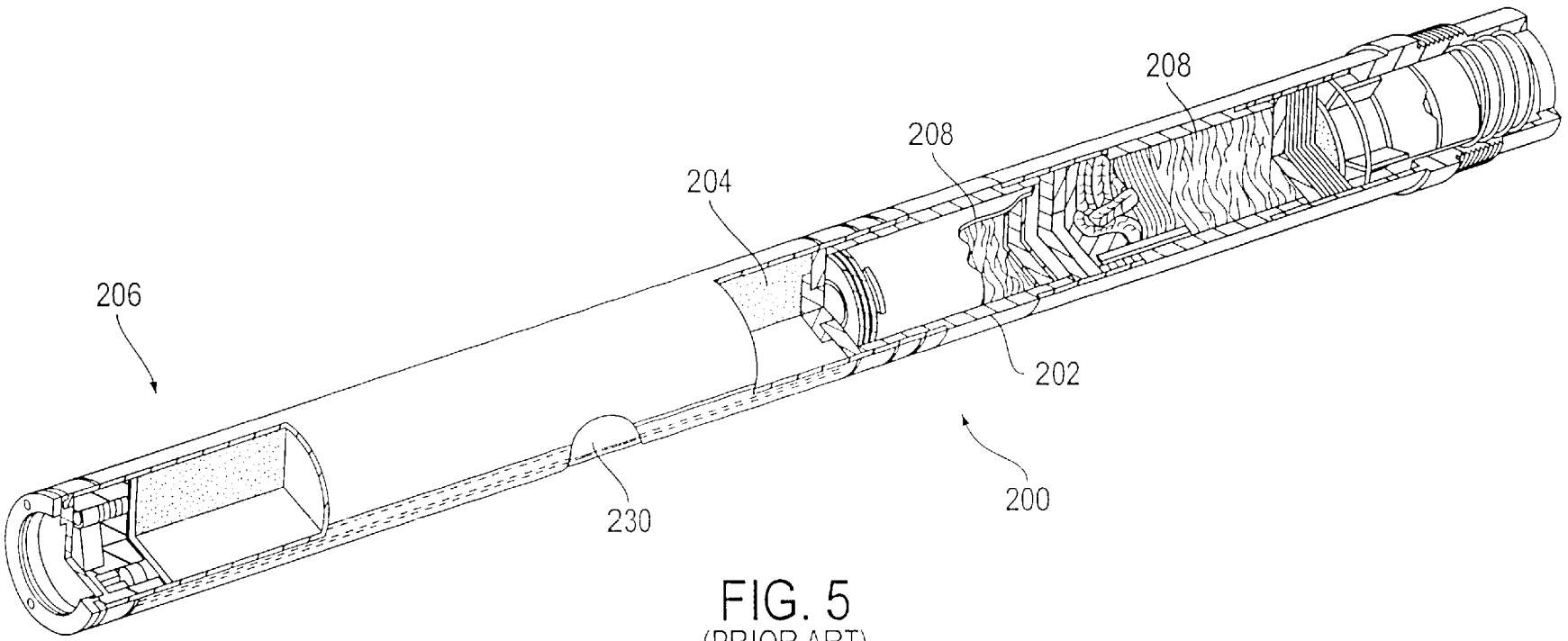
FIG. 5 (PRIOR ART)
FIG. 5 is a partially sectioned view of a known flare.
Figure 6:
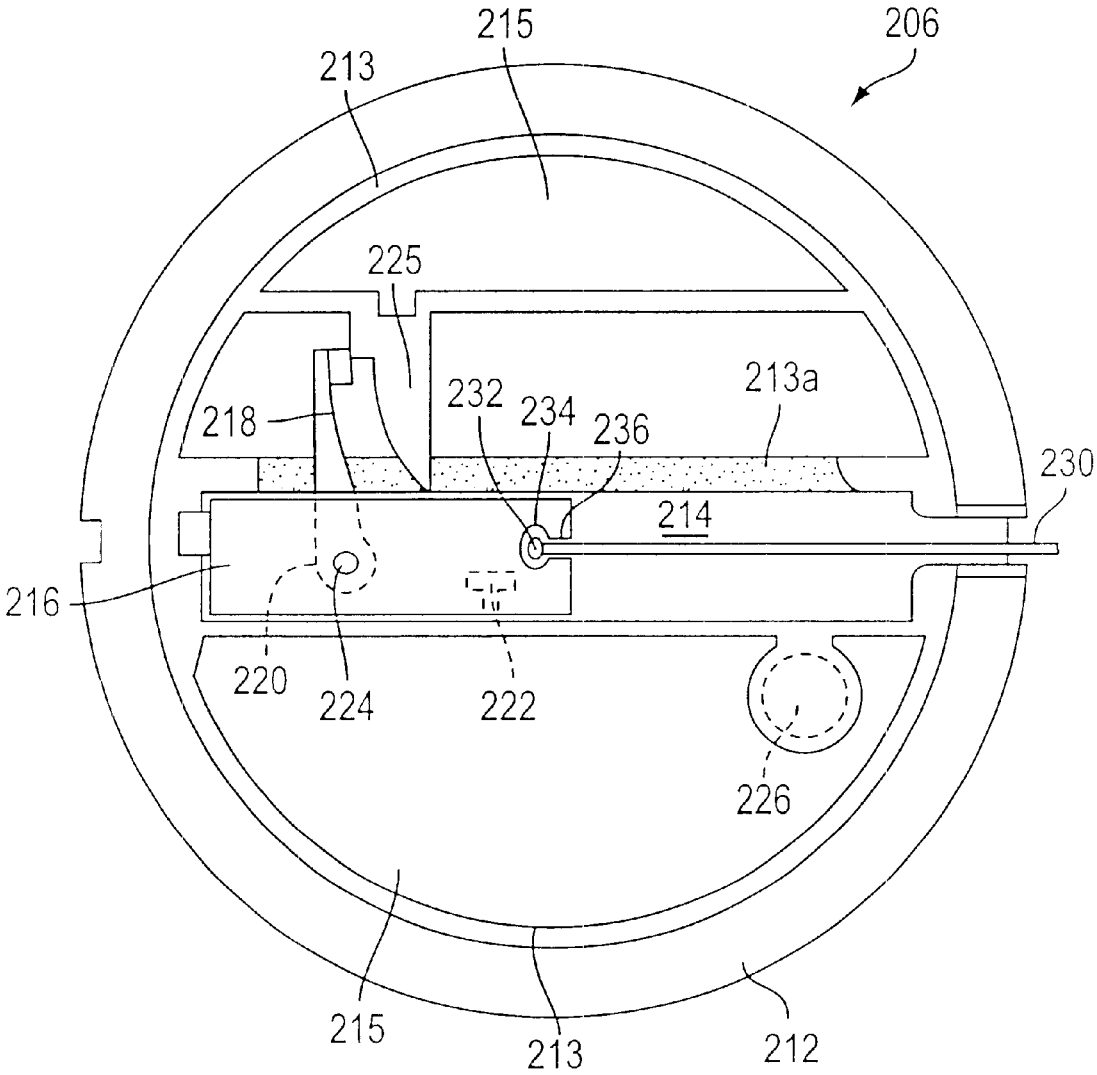
FIG. 6 (PRIOR ART)
FIG. 6 is a plan, partially phantomed view of a known igniter assembly, depicting a slider and striker arm of the igniter assembly in a loaded state.
Figure 7:
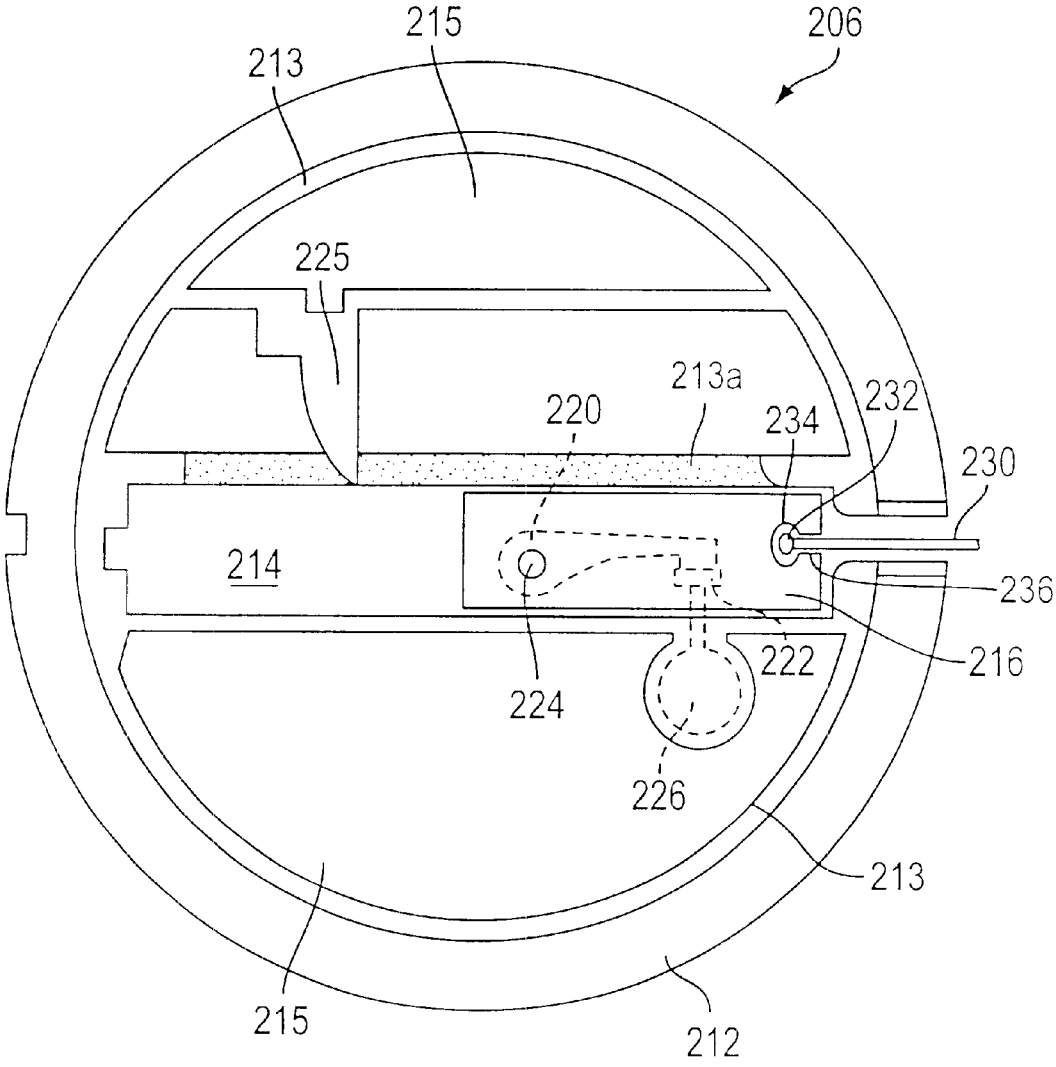
FIG. 7 (PRIOR ART)
FIG. 7 is a plan, partially phantomed view of the known igniter assembly of FIG. 6, but depicting the slider and striker arm in a firing state.

An example of a basic design of the illuminating flare with which the igniter of this invention is compatible is shown in FIG. 5. In the interest of brevity, and because the design of known illuminating flares is within the purview of the skilled artisan, the following discussion will be limited to the novel igniter assembly of this invention.

Figure 1:
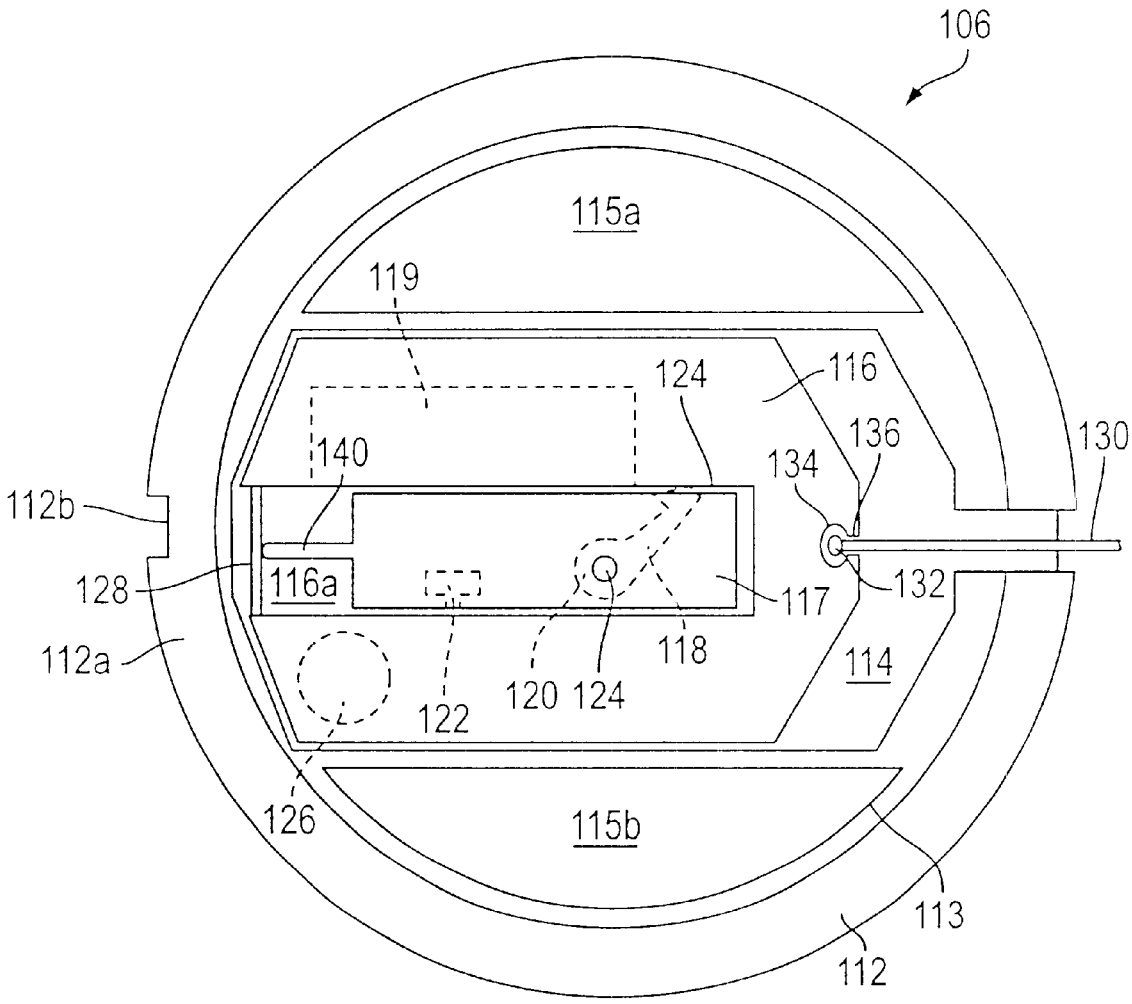
FIG. 1 is a plan, partially phantomed view of an igniter assembly (without an enclosure cap) in accordance with one embodiment of this invention, depicting a slider and striker arm of the igniter assembly in a loaded state.
Figure 4:
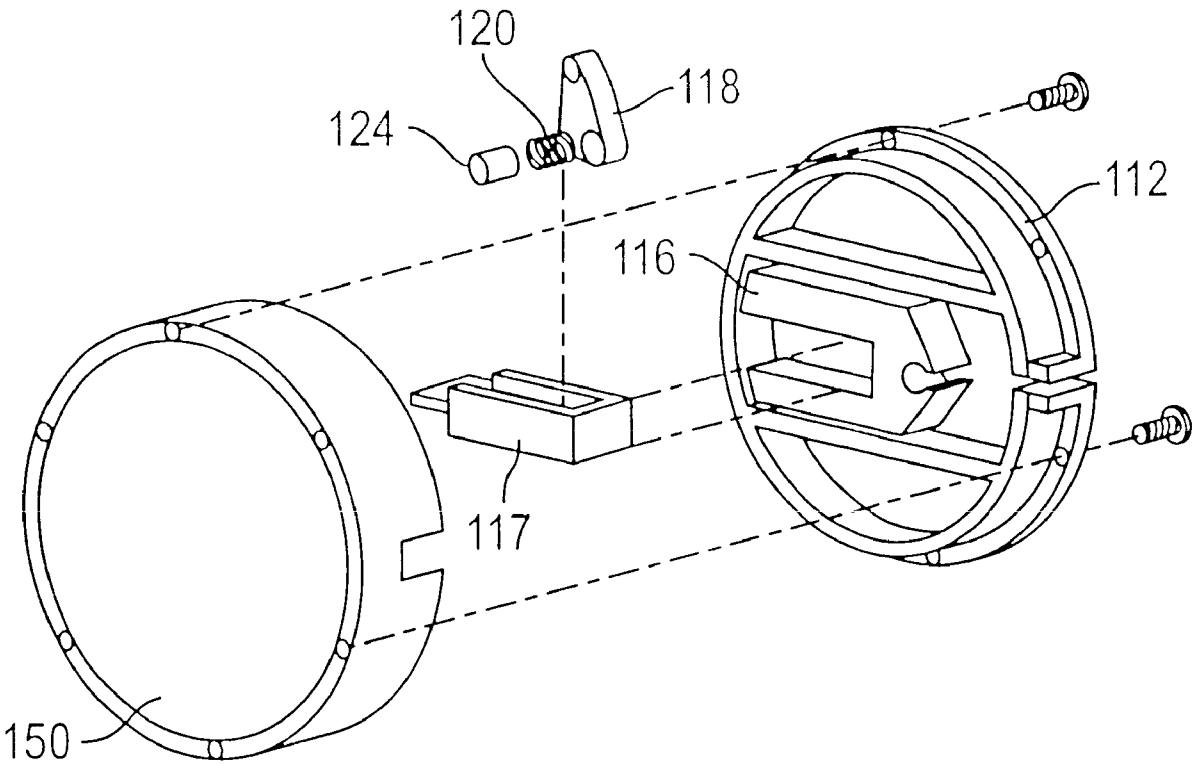
FIG. 4 is an exploded perspective view of the igniter assembly of FIGS. 1–3.

Referring to FIG. 1, the igniter 106 includes a housing 112 formed of a molded piece of LEXAN (polycarbonate). The housing 112 has longitudinally extending internal walls 113, which are receivable into an aluminum cap 150 (FIG. 4) of the casing so that peripheral portion 112*a* of the housing 112 abuts the periphery of the aluminum cap 150. Groove 112*b* assists in aligning the housing 112 and the aluminum cap 150 with the flare body. The internal walls 113 define a top hollow compartment 115*a*, a bottom hollow compartment 115*b*, and a diametrically extending slider raceway 114. Although the compartments 115*a* and 115*b* are optional, their presence is preferred in order to lower material costs and provide a venting feature discussed in greater detail below. A sliding mechanism (also referred to herein as a slider) 116 is disposed in the raceway 114 and is slidable along at least a portion of the raceway 114. In a preferred embodiment, the slider 116 is capable of sliding about 0.5 inches (about 1.27 cm) along the raceway 114. Each of the internal walls 113 defining the raceway 114 has a depth (perpendicular to the plane of FIG. 1) set substantially equal to the depth of the sliding mechanism 116.

Figure 2:
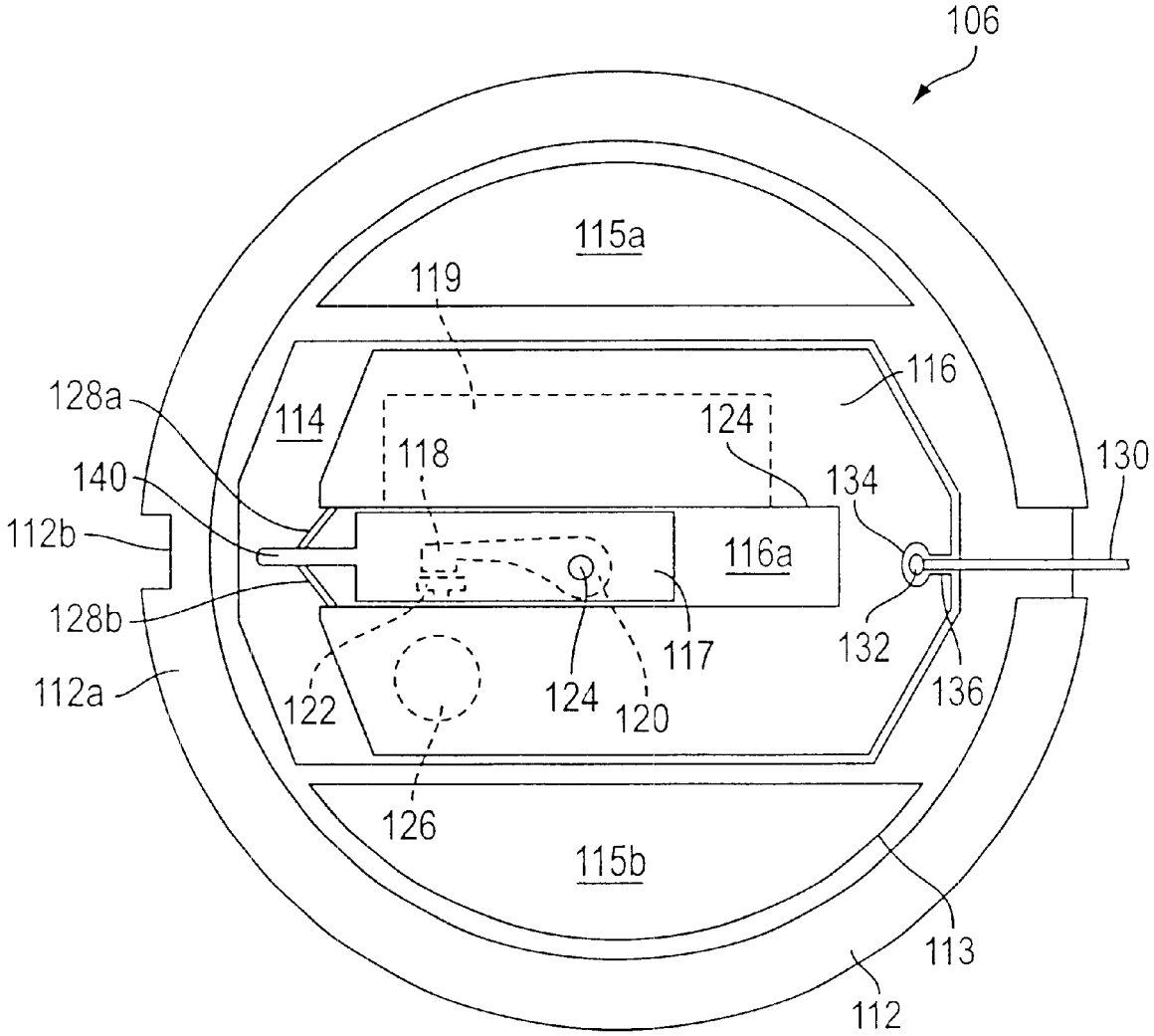
FIG. 2 is a plan, partially phantomed view of the igniter assembly of FIG. 1, but depicting the slider and striker arm in a firing state.

The slider 116 is movable between a loaded state depicted in FIG. 1 and a firing state depicted in FIG. 2. Referring to FIG. 1, the slider 116 has a central pocket 116*a* constructed and arranged to receive a stationary cartridge 117. (Although not shown in the figures, the cartridge 117 can further be provided with a pin hole and pin for retaining the striker arm 118 in the cocked position during assembly.) The slider 116 comprises a motion restricting bridge 128 positioned at an open end of the central pocket 116*a*. A stationary cutter 140 of the cartridge 117 is positioned in the central pocket 116*a* and contacts the motion restricting bridge 128. Although not shown, the region of the motion restricting bridge 128 contacted by the stationary cutter 140 may contain a notch to facilitate fracture of the bridge 128. When in the loaded state depicted in FIG. 1, contact between the motion restricting bridge 128 and the stationary cutter 140 obstructs the slider 116 from sliding towards the firing position depicted in FIG. 2, unless a sufficient force is applied to the slider 116 to break the bridge 128 along cutter 140. The slider 116 also has incorporated therein a pellet cavity 126 and striker pin clearance slot (also referred to herein as the striker arm clearance slot) 119, the purpose of which will be explained in greater detail below. An aluminum strip (not shown) lines a portion of the pellet cavity 126 through which the explosion from the primer 122 penetrates during actuation. The aluminum strip serves to protect the pellets from accidental ignition in the event that the primer material undergoes undesired ignition by means other than the striker arm. The pellet cavity 126 is movable into communication with a wafer (not shown), which is in communication with solid illuminant fuel. The pellet cavity 126 contains an ignitable composition, such as boron potassium nitrate ($BKNO_3$) pellets. Preferably, the pellet cavity 126 is capable of receiving at least eleven $BKNO_3$ pellets. (The pellets are preferably loaded into the cavity 126 after the igniter assembly has been assembled. Since the pellet cavity 126 moves, an oblong hole is provided in the base of the housing to allow pellet loading through the housing, as well as communication between the pellet cavity 126 and the wafer over the entire path of movement of the pellet cavity 126.) The size of the slider 116 is determined by taking into account the diameter of the boron pellet cavity and the clearance slot 119 needed for passage of the spring-loaded striker arm 118.

Figure 8:
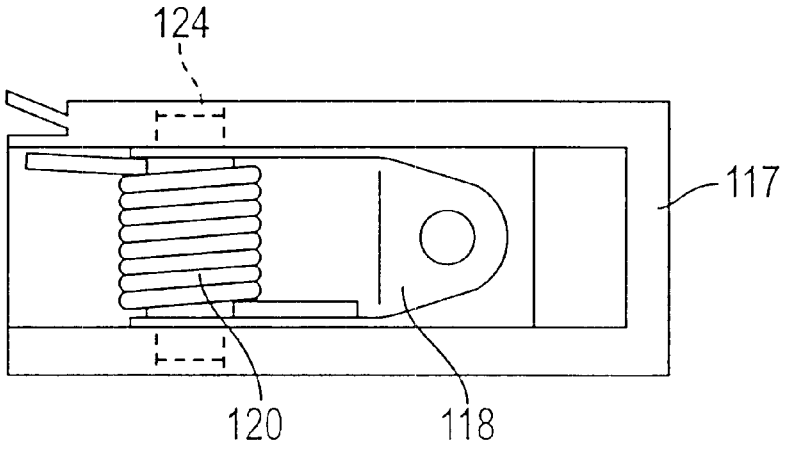
FIG. 8 is a top plan view of a cartridge depicting the striker arm in a fired position.
Figure 9:
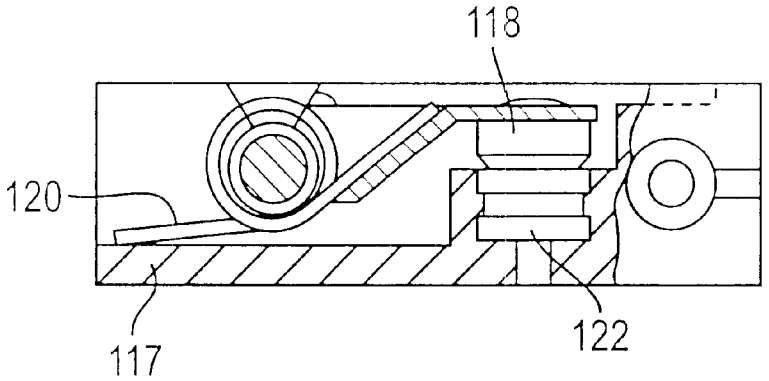
FIG. 9 is a side sectional view of the cartridge of FIG. 8.

As shown in FIGS. 8 and 9, the cartridge 117 is generally of a known construction and comprises the spring-loaded striker arm 118, a torsion spring 120, and a pistol primer 122. The cartridge 117 can be either formed separately from the housing 112 or injection molded into the housing 112 during formation of the housing 112 so that the cartridge 117 and housing 112 are integral. The striker arm 118, the torsion spring 120, and the pistol primer 122 are then assembled in the cartridge 117. In the loaded state illustrate in FIG. 1, the torsion spring 120 urges the striker arm 118 to pivot about pin 124 towards the position shown in FIG. 2 in which the striker arm 118 is seated against the primer 122. However, when the slider 116 is in the loaded state, a cocking wall portion 124 of the slider 116 obstructs the striker arm 118 from moving from its cocked position towards the primer 122.

The slider 116 is operatively connected to the parachute via cable (or lanyard) 130, which extends along an axial channel (not shown) contained in the flare body. The cable 130 is attached to the slider 116 via a swage ball 132, which is accommodated within recess 134 of the slider 116 for securing the cable 130 to the slider 116. The recess 134 is in communication with a slot 136, which is sufficiently wide to permit passage of the cable 130, but sufficiently narrow to obstruct passage of the swage ball 132 therethrough. Preferably, the cable 130 is aligned with the longitudinal axis (center) of the slider 116. Instead of using a roller pin to redirect the cable 130 near the end of the flare, a LEXAN molded surface having a relatively large radius can be used to redirect the cable 130 towards the longitudinal axis of the slider 116. Enlarging of the turn radius reduces the likelihood of cable 130 breakage.

In operation, the igniter 106 is actuated by the force generated upon parachute deployment. Upon actuation of the parachute, the cable 130 is pulled with the deploying parachute. When properly operated, the force imparted on the cable 130 by the deploying parachute is sufficient to cause the cable 130 to pull the slider 116 from its loaded state to its firing state while simultaneously breaking motion restricting bridge 128 along the stationary cutter 140. After the bridge 128 has been broken, the bridge segments (designated by reference numerals 128*a* and 128*b* in FIG. 2) flare over the cutter 140 and keep the slider 116 from moving backwards (i.e., towards its loaded state position). The cutter 140 is preferably designed with a small radius on the tip rather than a sharp edge, so that over time the edge of the cutter 140 will not wear throught the bridge 128 due to normal vibrations experienced during transportation of the flare.

Figure 3:
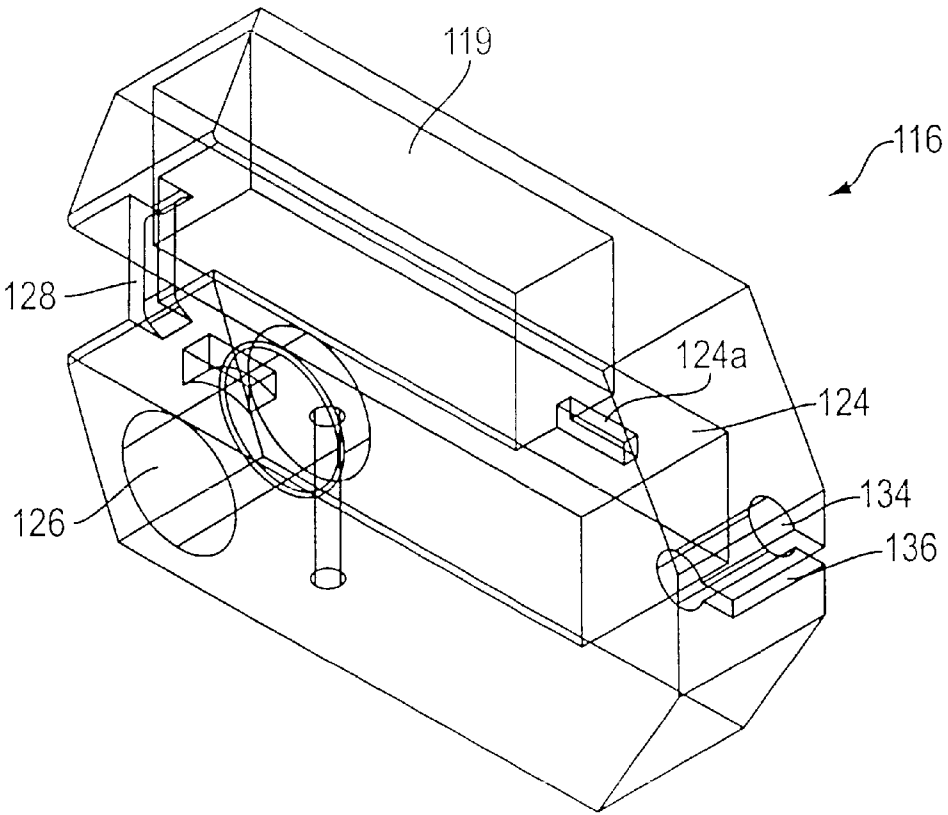
FIG. 3 is an isolated, perspective view of the slider of the igniter assembly of FIGS. 1 and 2.

Movement of the slider 116 into the firing state depicted in FIG. 2 moves the striker arm 118 out of contact with cocking wall portion 124 and aligns the striker arm 118 with striker pin clearance slot 119. As shown in FIG. 3, the cocking wall portion 124 can contain a guide slot 124*a* for receiving the striker pin (unnumbered) at the distal end of the striker arm 118. Provision of this guide slot 124*a* prevents the tip of the striker pin from becoming embedded in the wall portion 124, thus further enhancing the reliability of the igniter. The striker arm 118 is hence permitted to move through the striker pin clearance slot 119 (due to the urging force imparted by the torsion spring 120) until the striker arm 118 strikes against the primer 122.

Movement of the slider 116 into the firing state depicted in FIG. 2 also moves the cavity 126 to align the cavity 126 with primer 122. Thus, detonation of the primer 122 starts an ignition sequence by which the $BKNO_3$ pellets, the wafer, and the illuminant composition are sequentially ignited.

The bridge 128 provides a variable safety feature for controlling the force required to move the slider 116. The stress on the bridge 128 is equal to force over area. By increasing the height of the bridge 128, more stress is required to break the bridge 128. In one embodiment, the bridge 128 height was set at about 0.0305 cm (0.12 inch) to 0.356 cm (0.14 inch) to prevent backward movement of the slider 116 and provide a minimum pull force requirement of at least 50 lbs force, more preferably 90 lbs force to move the slider 116 into the firing state shown in FIG. 2.

As mentioned above, the bridge 128 can be provided with a notch for facilitate fracture of the bridge 128 with cutter 140.

Another optional safety feature is the provision of one or more holes (not shown) through the walls 113 defining the raceway 114 so that, if by some mishap the primer 122 were to unintentionally ignite before the slider 116 is moved to its firing state, the gases generated by ignition of the primer 122 can be vented to one or both of the outside compartments 115*a* and 115*b* to prevent ignition of the $BKNO_3$ pellets.

In identifying suitable materials for making the igniter assembly, the following criteria were taken into consideration: (a) form the igniter housing and slider from a material having a friction coefficient at least as low as LEXAN sliding against LEXAN; (b) permit inspection of igniter assembly by making housing from a transparent material; (c) provide good mating properties with aluminum case by choosing material having low coefficient of thermal expansion; and (d) select materials having high impact strength to avoid shattering, high tensile strengths to avoid breakage at cable slot, and high glass transition and distortion temperatures. Preferably, polycarbonate is selected as the material of choice for the igniter housing and polycarbonate with 7% TEFLON is selected as the material of choice for the slider.

Representative infrared illuminating compositions that may be used with this invention are disclosed in U.S. Pat. Nos. 3,411,963, 5,056,435, 5,587,522, 5,912,430, and 6,123,789, the disclosures of which are incorporated herein by reference.

Parachute deployment systems and conventional flare assemblies modifiable for use with the igniter of this invention are disclosed in U.S. Pat. Nos. 5,386,781 and 5,347,931, the disclosures of which are incorporated herein by reference.

The foregoing detailed description of the invention has been provided for the purpose of explaining the principles of the invention and its practical application, thereby enabling others skilled in the art to understand the invention for various embodiments and with various modifications as are suited to the particular use contemplated. The foregoing detailed description is not intended to be exhaustive or to limit the invention to the precise embodiments disclosed. Modifications and equivalents will be apparent to practitioners skilled in this art and are encompassed within the spirit and scope of the appended claims.

What is claimed is:

1. An igniter assembly for a parachute flare which includes a flare composition and a parachute, said igniter assembly comprising:

a housing having internal walls defining a raceway;

a cartridge disposed in said raceway and retained in a stationary state relative to said housing, said cartridge comprising a stationary primer and a spring;

a striker arm connected to said cartridge and said spring and movable into a cocked state in which said spring urges said striker arm towards said primer;

a slider disposed in said raceway and having an igniter composition chamber and a cocking wall portion, said slider being movable in tandem with said igniter composition chamber along at least a portion of the length of said raceway from a loaded position in which said striker arm is maintained in the cocked state by said cocking wall portion to a firing position in which said igniter composition chamber is aligned and in communication with said primer and said striker arm is free of said cocking wall portion to permit said spring to drive said striker arm from the cocked state into said primer with the force sufficient to strike and detonate said primer.

2. The igniter assembly of claim 1, further comprising a parachute cable for connecting said slider to the parachute and, upon deployment of the parachute, moving said slider from the loaded position io the firing position.

3. The igniter assembly of claim 2, wherein said parachute cable is aligned with a central axis of said slider.

4. The igniter assembly of claim 1, wherein said spring comprises a torsion spring.

5. The igniter assembly of claim 1, wherein said cartridge further comprises a stationary cutter and wherein said slider further comprises a motion restricting bridge contacting said stationary cutter and restricting movement of said slider between the loaded and firing positions so that movement of said slider from the loaded position to the firing position requires that said stationary cutter fracture said motion restricting bridge.

6. The igniter assembly of claim 1, wherein said internal walls defining said raceway have substantially the same depth as said slider.

7. The igniter assembly of claim 6, wherein said slider has a striker arm clearance slot through which said striker arm passes as said slider moves from the loaded position to the firing position.

8. The igniter assembly of claim 1, wherein said igniter composition chamber contains ignitable pellets.

9. The igniter assembly of claim 1, wherein:

said igniter assembly further comprises a parachute cable for connecting said slider to the parachute and, upon deployment of the parachute, moving said slider from the loaded position to the firing position;

said cartridge further comprises a stationary cutter;

said slider further comprises a motion restricting bridge contacting said stationary cutter and restricting movement of said slider between the loaded and firing positions so that movement of said slider from the loaded position to the firing position requires that said stationary cutter fracture said motion restricting bridge;

said internal walls defining said raceway have substantially the same depth as said slider; and said slider has a striker arm clearance slot through which said striker arm passes as said slider moves from the loaded position to the firing position.

10. A parachute flare assembly comprising an illuminant composition, a deployable parachute, an igniter assembly, and a cable connecting said parachute to said igniter assembly, said igniter assembly comprising:

a housing having internal walls defining a raceway;

a cartridge disposed in said raceway and retained in a stationary state relative to said housing, said cartridge comprising a stationary primer and a spring;

a striker arm connected to said cartridge and said spring and movable into a cocked state in which said spring urges said striker arm towards said primer;

a slider disposed in said raceway and having an igniter composition chamber and a cocking wall portion, said slider being movable in tandem with said igniter composition chamber along at least a portion of the length of said raceway from a loaded position in which said striker arm is maintained in the cocked state by said cocking wall portion to a firing position in which said igniter composition chamber is aligned and in communication with said primer and said striker arm is free of said cocking wall portion to permit said spring to drive said striker arm from the cocked state into said primer and strike said primer with the force sufficient to detonate said primer, and wherein said cable is connected to said slider so that deployment of said parachute causes said cable to move said slider from the loaded position to the firing position.

11. The parachute flare assembly of claim 10, wherein said cable is aligned with a central axis of said slider.

12. The parachute flare assembly of claim 10, wherein said spring comprises a torsion spring.

13. The parachute flare assembly of claim 10, wherein said cartridge further comprises a stationary cutter and wherein said slider further comprises a motion restricting bridge contacting said stationary cutter and restricting movement of said slider between the loaded and firing positions so that movement of said slider from the loaded position to the firing position requires that said stationary cutter fracture said motion restricting bridge.

14. The parachute flare assembly of claim 10, wherein said internal walls defining said raceway have substantially the same depth as said slider.

15. The igniter assembly of claim 14, wherein said slider has a striker arm clearance slot through which said striker arm passes as said slider moves from the loaded position to the firing position.

16. The parachute flare assembly of claim 10, wherein said igniter composition chamber contains ignitable pellets.

17. The igniter assembly of claim 10, wherein:

said cartridge further comprises a stationary cutter;

said slider further comprises a motion restricting bridge contacting said stationary cutter and restricting movement of said slider between the loaded and firing positions so that movement of said slider from the loaded position to the firing position requires that said stationary cutter fracture said motion restricting bridge;

said internal walls defining said raceway have substantially the same depth as said slider; and said slider has a striker arm clearance slot through which said striker arm passes as said slider moves from the loaded position to the firing position.

* * * * *